US005791110A

United States Patent [19]

Traynor

[11] Patent Number: 5,791,110

[45] Date of Patent: Aug. 11, 1998

[54] INTERACTIVE DECORATIVE TILES

[76] Inventor: Phyllis Traynor, 33 Lower Trinity Pass, Pound Ridge, N.Y. 10576

[21] Appl. No.: 792,175

[22] Filed: Jan. 30, 1997

[51] Int. Cl.[6] ..... E04F 13/00

[52] U.S. Cl. ..... 52/311.2; 52/105; 52/311.1

[58] Field of Search ..... 52/311.1, 311.2, 52/311.3, 314, 316, 105, 315

[56] References Cited

U.S. PATENT DOCUMENTS

| | | | |
|---|---|---|---|
| 1,539,148 | 5/1925 | Sylvester | 52/311.1 X |
| 4,877,405 | 10/1989 | Stewart | 52/105 X |
| 5,196,248 | 3/1993 | Danico et al. | 52/389 X |
| 5,411,780 | 5/1995 | Kaefer | 52/316 X |
| 5,619,830 | 4/1997 | Osborn | 52/311.2 |

*Primary Examiner*—Creighton Smith
*Attorney, Agent, or Firm*—Patrick J. Walsh

[57] ABSTRACT

A set of one or more tiles is provided with a partially complete design permanently inscribed thereon for use in guiding the user to complete the design including structural and artistic elements of the completed design.

3 Claims, 3 Drawing Sheets

INTERACTIVE DECORATIVE TILES

BACKGROUND OF THE INVENTION

The present invention relates to tiles and particularly to the preparation and use of tiles with partial drawings thereon as an aid in inspiring a user's artistic creativity in completing or embellishing the partial drawing.

SUMMARY OF THE INVENTION

In accordance with the present invention, a set of one or more tiles is provided with a partially complete design permanently inscribed thereon for use in guiding the user to complete the design including structural and artistic elements of the completed design. The tiles are preferably ceramic, glazed and fired, and with a partially completed design incorporated in the tile during the manufacture thereof. The design is preferably applied under the glazed finished surface and remains permanently visible through the glazing. Alternatively the design may be applied to the tile surface, glazed or otherwise as is known in the art, by any suitable manufacturing technique.

The surface of the tiles remains glossy, smooth, and waterproof, so that the tiles may be cleaned and reused over and over again in accordance with the invention without harm to the permanent image inscribed during manufacture.

The tiles may be installed on any planar surface such as a table, wall, or playroom floor, or on a specially made frame for mounting the tiles. When assembled the tiles form the incomplete design for inspiring the user to use imagination and artistic ability in completing or embellishing the design. The user employs any commercially available writing or drawing instrument with washable ink permitting removal from the tiles as and when desired.

When installed on a wall, table or floor a set of tiles according to the invention provides a permanent protective waterproof surface of general utility that is easy to clean, and does not require storage or set-up anytime a user wishes to create or embellish a picture on the permanent image inscribed on the tiles.

In one embodiment of the invention, the tiles may be assembled in kit form together with a selection of colored markers suitable for coloring the tiles, double adhesive mounting squares for installing the tiles, an instruction booklet on use of the kit including suggested decorating techniques, and recommendations for cleaning the tiles after application of various decorating media. All materials and recommendations are tailored primarily for safety and use by children with minimal adult supervision, while enhancing a child's level of interest in participation.

OBJECTS OF THE INVENTION

An object of the invention is to provide interactive decorative tiles having a permanent image inscribed thereon to inspire artistic talent in completing or embellishing a design based on the permanent image.

Another object of the invention is to provide interactive decorative tiles for permanent installation to provide a permanent image in outline for use as a base in completing a picture.

Another object of the invention is to provide a kit including interactive decorative tiles, drawing instruments, installation materials, and instructions particularly suited for use in inspiring children to develop artistic talent by completing a picture utilizing a permanent outline image inscribed on the tiles.

Other and further objects of the invention will become apparent with an understanding of the following detailed description of the invention or upon employment of the invention in practice.

A preferred embodiment of the invention has been chosen for purposes of detailed description and is shown in the accompanying drawing in which.

DETAILED DESCRIPTION OF THE PREFERRED EMBODIMENT

Figure 1:
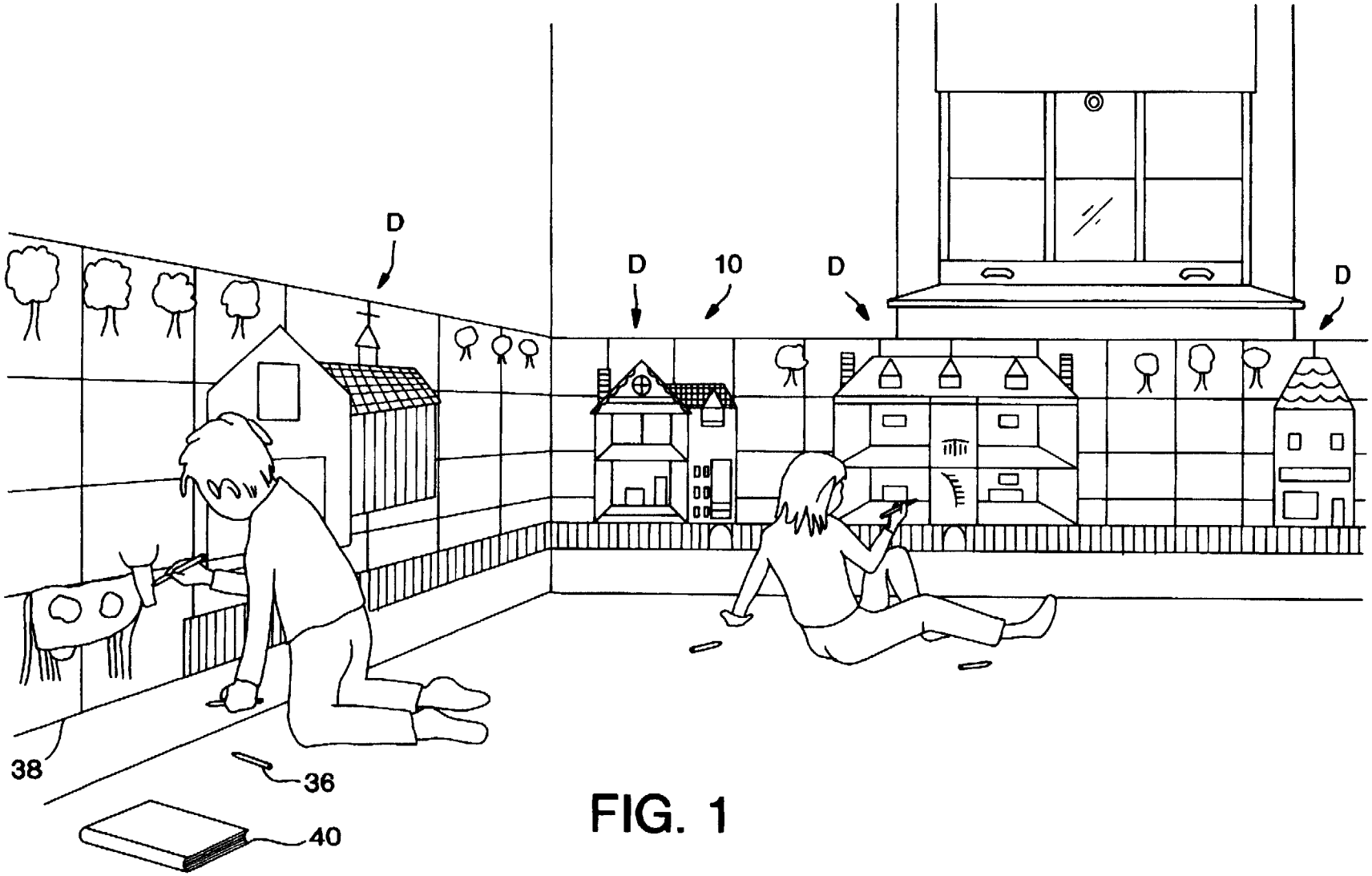
FIG. 1 is a perspective view of a room section illustrating interactive decorative tiles according to the invention mounted on wall surfaces.

Referring to the drawing, FIG. 1 illustrates the corner of a room in which interactive decorative tiles 10 have been permanently mounted on the lower reaches of the walls. The tiles are provided with partially complete or unfinished designs D permanently inscribed thereon for use in guiding the user to complete the design including structural and artistic elements of the completed design. The unfinished design may be in any suitable form such as dash lines or guidelines suggestive of any object or figure familiar to the user. As shown, individual tiles may be inscribed with part of an overall pattern that becomes apparent when the tiles are assembled and installed in the particular order for the structures and other elements of FIG. 1.

The unfinished designs as well as overall patterns stimulate the artistic imagination of users who use writing or drawing instruments to complete or embellish the designs.

During manufacture the tiles are inscribed with partially completed designs D incorporated with the design being permanently applied. The tiles are preferably glazed ceramics with the design applied under the glazed surface to remain permanently visible through the glazing.

Figure 2:
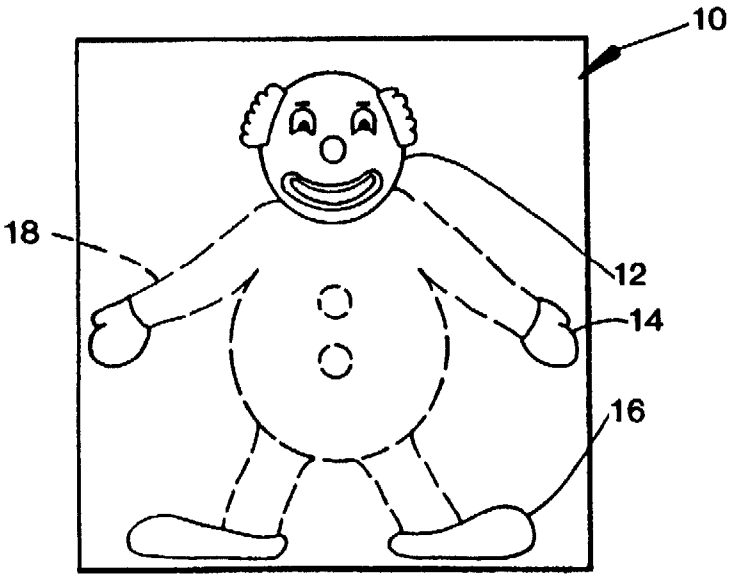
FIG. 2 is a plan view of a single interactive decorative tile having thereon an unfinished design for completion or embellishment by the user.

For example, in the form of the invention shown in FIG. 2, a single ceramic tile 10 contains an incomplete design of a clown consisting of head 12, hands 14, and feet 16 indicated by solid lines permanently inscribed on the tile. The design may be completed by the user by drawing a body 18 as shown by the dash lines to form a complete image. The user may also color the completed picture.

Figure 3:
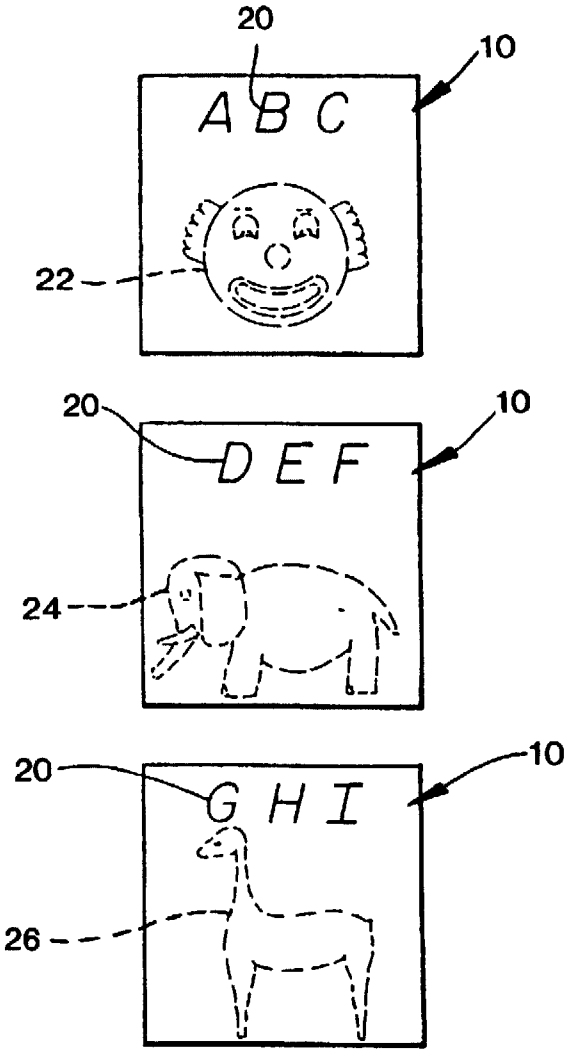
FIG. 3 is a plan view of a set of three tiles each bearing an incomplete design and with related letter sequences.

FIG. 3 illustrates individual tiles 10 having premarked letters 20 permanently inscribed thereon for education of children. The letters prompt the user to illustrate a figure such as a clown 22, elephant 24, or giraffe 26 on the tile corresponding to one of the letters.

Figure 4:
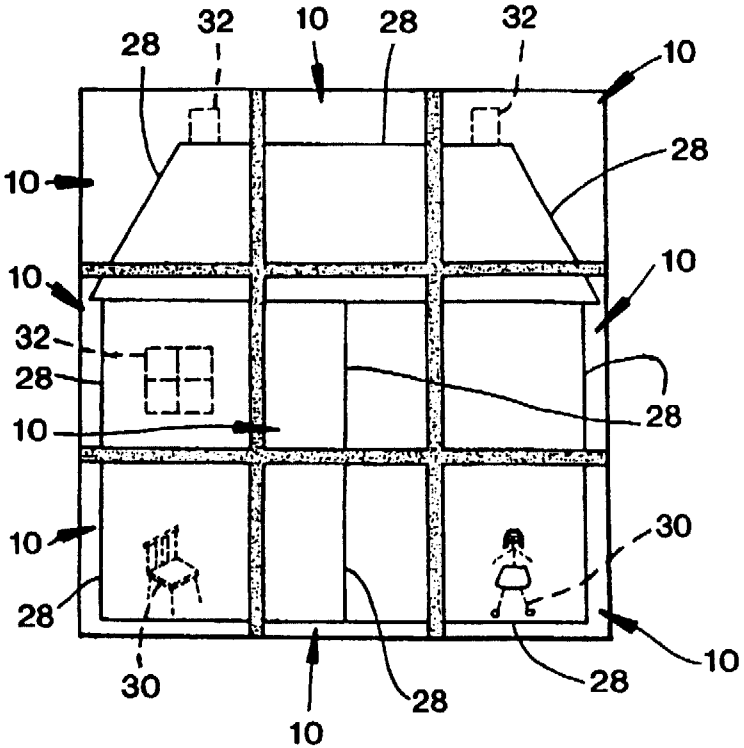
FIG. 4 is a plan view of another set of tiles each having a portion of a larger unfinished design formed by assembly of the tiles in particular order.

FIG. 4 illustrates a group of tiles 10 each having a portion 28 of an incomplete or unfinished design or pattern. The tiles are assembled in order to define the overall pattern. The user may add a variety of FIGS. 30 and components 32 in embellishing the pattern.

Figure 5:
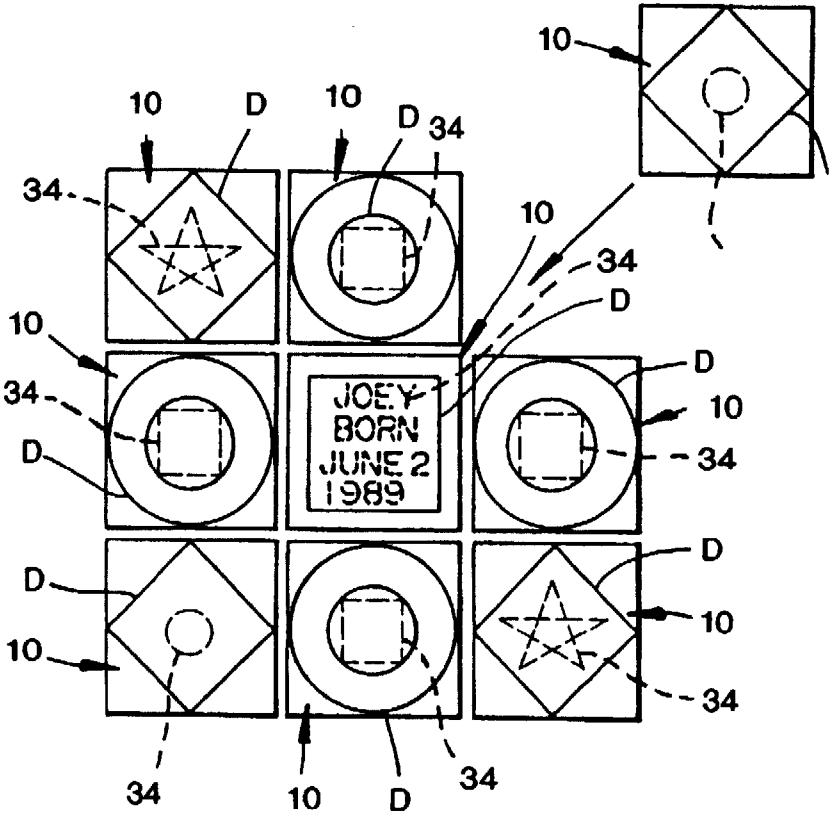
FIG. 5 is a plan view of another set of tiles in accordance with the invention each tile bearing an unfinished design and with the tiles intended for arrangement in a pattern consisting of individual tile designs.

FIG. 5 illustrates a group of tiles 10 each having a permanent design D with the tiles assembled in variable patterns and with the user invited to complete or embellish the designs by adding a variety of geometric FIGS. 34.

The interactive decorative tiles may be in kit form including drawing instruments 36, installation materials 38, and instructions 40 illustrated in FIG. 1.

Various changes may be made to the structure embodying the principles of the invention. The foregoing embodiments are set forth in an illustrative and not in a limiting sense. The scope of the invention is defined by the claims appended hereto.

I claim:

1. An interactive decorative tile for embellishment by a user comprising a ceramic tile having a glazed surface thereon, the tile being inscribed with a permanent, unfinished design with the design being visible over the glazed surface, the unfinished design for prompting the user to complete or embellish the design, and a removable image to be drawn on the tile surface.

2. A set of interactive decorative tiles for embellishment by a user comprising a set of ceramic tiles, each tile in the set having a glazed surface thereon, each tile being permanently inscribed with a portion of an unfinished design pattern, the portion of pattern being visible from the glazed surface, the unfinished design pattern being formed by assembly of the tiles in particular order, the interactive decorative tiles for prompting the user to complete or embellish the pattern, and an instrument forming an image on the surface of the tiles that is to be cleaned from the tiles without harm to the permanent unfinished design pattern.

3. A kit comprising a set of interactive decorative ceramic tiles for embellishment by a user, each tile in the set having a glazed surface thereon, each tile being permanently inscribed with a portion of an unfinished design pattern, the portion of pattern being visible from the glazed surface, the unfinished design pattern being formed by assembly of the tiles in particular order, the interactive decorative tiles for prompting the user to complete or embellish the pattern, instruments to embellish the tiles by forming an image on the surface of the tiles that is to be cleaned from the tiles without harm to the permanent unfinished design pattern, and an instruction leaflet to install and embellish the tiles.

* * * * *